US009193211B2

(12) United States Patent
Nielsen et al.

(10) Patent No.: US 9,193,211 B2
(45) Date of Patent: Nov. 24, 2015

(54) MULTI-PAGE PRESENTATION AND STORAGE FOLDER AND METHOD OF USE

(71) Applicants: Andrew Nielsen, Santa Clara, UT (US); Perry Jensen Nielsen, Santa Clara, UT (US)

(72) Inventors: Andrew Nielsen, Santa Clara, UT (US); Perry Jensen Nielsen, Santa Clara, UT (US)

(73) Assignee: MUZICSCAPE LLC, Santa Clara, UT (US)

( * ) Notice: Subject to any disclaimer, the term of this patent is extended or adjusted under 35 U.S.C. 154(b) by 0 days.

(21) Appl. No.: 14/271,102

(22) Filed: May 6, 2014

(65) Prior Publication Data

US 2014/0346217 A1 Nov. 27, 2014

Related U.S. Application Data

(60) Provisional application No. 61/825,759, filed on May 21, 2013.

(51) Int. Cl.

| | |
|---|---|
| ***B42D 15/00*** | (2006.01) |
| ***B42F 7/06*** | (2006.01) |
| *G09F 23/10* | (2006.01) |

(52) U.S. Cl.

CPC ..... *B42F 7/065* (2013.01); *B42D 15/00* (2013.01); *G09F 23/10* (2013.01)

(58) Field of Classification Search

CPC ..... B42D 15/00; G09F 23/10; G09F 3/0286
USPC ..... 40/654.01, 611.08, 539, 124.11, 24.12; 206/278; 150/147, 138; 283/56; 281/2, 281/5

See application file for complete search history.

(56) References Cited

U.S. PATENT DOCUMENTS

| | | | | |
|---|---|---|---|---|
| 2,718,911 | A * | 9/1955 | Solomon | 150/147 |
| 2,908,308 | A * | 10/1959 | Dearholt | 206/296 |
| 3,286,831 | A * | 11/1966 | Giberstein | 206/278 |
| 3,958,348 | A * | 5/1976 | Sakamoto | 40/374 |
| 5,711,627 | A * | 1/1998 | Chapman | 402/3 |
| 6,334,631 | B1 * | 1/2002 | Hollander | 283/56 |
| 6,938,931 | B1 * | 9/2005 | Davis | 281/31 |

* cited by examiner

*Primary Examiner* — Syed A Islam
(74) *Attorney, Agent, or Firm* — Stoel Rives LLP

(57) ABSTRACT

A multi-page presentation folder is described that is capable of securing and displaying one or more sheets of material, such as sheets of music. One or more sheets may be secured and displayed via each panel of the multi-page presentation folder. In various embodiments, for a given number of page turns, a greater number of sheets may be displayed and/or presented. For example, in one embodiment, a multi-page presentation folder allows user to "turn a page" only once to view up to six sheets or only twice to view up to eight sheets. The folder may also provide stability to the sheets of material preventing them from sagging.

18 Claims, 9 Drawing Sheets

MULTI-PAGE PRESENTATION AND STORAGE FOLDER AND METHOD OF USE

TECHNICAL FIELD

This disclosure relates generally to a folder for displaying, carrying, and/or storing pages of music, print material, or the like. More specifically, the present disclosure relates to a folder which allows multiple pages to be displayed with a reduced number of manual page turns.

SUMMARY

A folder for carrying and displaying sheets of material as described herein may include two or more panels, each of the panels having two vertical edges and being connected to at least one other panel by at least one vertical edge and forming two or more connected vertical edges, the folder being foldable along each of the connected vertical edges. Each of the panels may have a front side and a back side, with one or both of the front side and back side of each of the four panels having an attachment member configured to hold at least one sheet of material.

BRIEF DESCRIPTION OF THE DRAWINGS

Non-limiting and non-exhaustive embodiments of the disclosure are described herein, including various embodiments of the disclosure with reference to the figures described below.

Figure 1A:
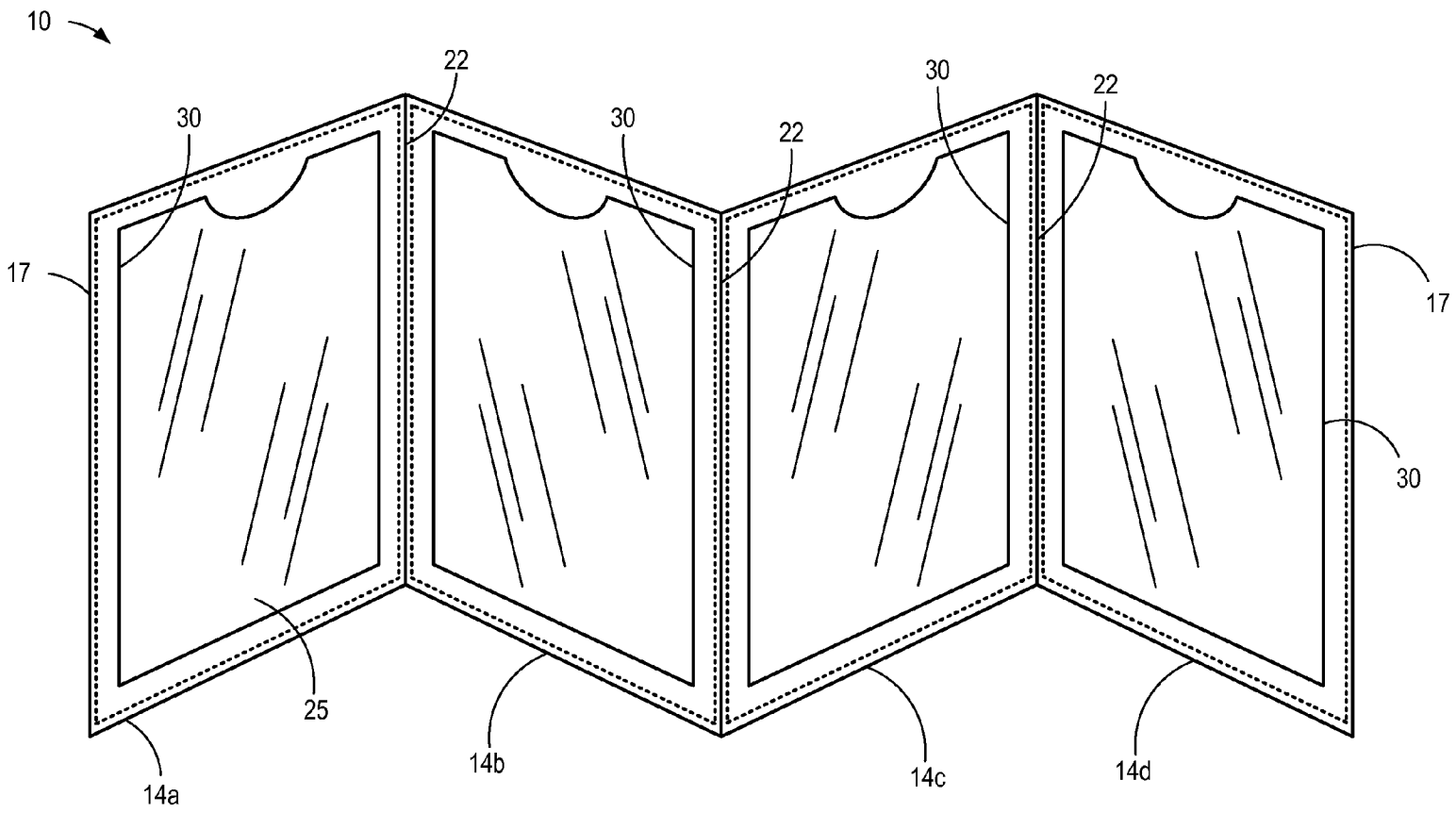
FIG. 1A shows a perspective front view of a multi-page presentation folder as, described herein.

References to the figures throughout the description are for convenience only. As provided herein, embodiments of the systems and methods described herein may include one or more additional components or features not illustrated in the figures. Similarly, one or more of the illustrated components or features may be omitted and/or substituted for a different component or feature in any of the embodiments described herein. Furthermore, the described features, structures, or characteristics may be combined in any suitable manner in one or more alternative embodiments.

DETAILED DESCRIPTION

During the course of the performance and practice of music, it may be useful for the performer to read sheet music of compositions. Often sheet music compositions are multiple pages in length. This may necessitate that the performer turn the sheet music while performing. Depending on how the sheet music is scored for these page turns, they can often be inconvenient and as a result, the musician may be forced to omit some of the music in order to make the page turn.

A professional musician performing at a concert may have someone else to follow—along in the music and turn the pages manually for the musician. However, this option is inconvenient and/or costly. Musicians may also attempt to limit page turns by taping multiple pages together (such as 3 or 4 pages) and then pull all the taped pages away at once. This may be referred to as a "page throw." A page throw may be difficult to execute and if used during a performance and can be distracting for the audience. Additionally, sheets of music standing alone can sag and may not be displayed flat, making it more difficult for the musician to read the notes.

Accordingly, the present disclosure includes a folder and method for displaying sheets of music in a way that limits the necessary manual page turns. According to one embodiment, the folder may include four panels connected in a row, with one or more of the panels having a front side configured to hold a sheet of material and a back side configured to hold a sheet of material.

According to one configuration, the four panels may be connected to one another by their vertical edges, and may be foldable along such connected vertical edges.

According to another embodiment of the present disclosure, the folder may include a semi-rigid or rigid material to support sheets of material and prevent them from sagging.

According to one embodiment of the present disclosure, at least one of the front and back sides of the panels has an attachment member disposed thereon configured to secure at least one sheet of material. Attachment members can be any known in the art, and according to one configuration, the attachment member may be a clear or transparent pocket configured to hold at least one sheet of material. Alternatively or additionally, the attachment member may include corner tabs, clips, adhesives, hook and loop fasteners (e.g., Velcro), frictional members, clamps, pins, magnetic retainers other members known to hold paper and the like.

In some embodiments, the clear or transparent pocket may be eraseably markable, such that annotations or marking may be made on the transparent pocket that reference the displayed sheet underneath. The markings may be subsequently removed or erased. In some embodiments, the transparent pocket may be formed by attaching a clear or transparent film (e.g., plastic) to a face of a panel. Thus, a panel may have plastic sheet attached to a front face and a back face in order to form a transparent pocket on each of the front face and the back face of the panel. The plastic sheet may be secured on at least a portion of at least two sides, or three of the four sides, in order to form a pocket with at least one opening. For example, the pocket(s) may have an opening on a top, bottom, and/or side(s) of the pocket.

In some embodiments, each panel may comprise a clear pocket. That is, a panel may comprise two sheets of transparent plastic joined on two or three edges such that sheets of music may be placed within the pocket back-to-back, such that the sheets are displayed facing in opposite directions.

According to various embodiments of the present disclosure, the folder may be stored and transported by folding it such that its dimensions are the width and height of a single panel, with a depth of four panels.

According to one embodiment of the present disclosure, the folder may be formed of two or more panels, with each of the panels having a front side and a back side, and one or more of the front sides and the back sides having one or more attachment members. The attachment members may cooperatively secure one or more sheets or individually secure one or more sheets.

These and other aspects of the present disclosure are realized in a music folder and method of use as shown and described in the following figures and related description. It will be appreciated that various configurations of the disclosure may not include each aspect set forth above and aspects discussed above shall not be read into the claims unless specifically described therein. The various embodiments of the disclosure may be used independent of one another and/or combined in any suitable combination or permutation of embodiments.

The following description is provided with reference to the accompanying drawings. The skilled artisan will understand, however, that the systems and methods described herein can be practiced without employing these specific details, and that the methods and systems can be used for purposes other than those described herein with or without modification. Indeed, the systems and methods described herein can be modified and used in conjunction with products and techniques known to those of skill in the art in light of the present disclosure. The drawings and descriptions are intended to provide examples of various aspects of various embodiments and are not intended to narrow the scope of the appended claims.

Furthermore, it will be appreciated that the drawings may show aspects of various embodiments in isolation and the elements in one figure may be used in conjunction with elements shown in other figures.

Reference in the specification to "one embodiment," "one configuration," "an embodiment," or "a configuration" means that a particular feature, structure, or characteristic described in connection with the embodiment may be included in at least one embodiment, etc. The appearances of the phrase "in one embodiment" in various places may not necessarily limit the inclusion of a particular element to a single embodiment, rather the element may be included in other or all embodiments discussed herein.

Furthermore, the described features, structures, or characteristics of embodiments of the present disclosure may be combined in any suitable manner in one or more embodiments. In the following description, numerous specific details are provided, such as examples of products or manufacturing techniques that may be used, to provide a thorough understanding of embodiments of the invention. One skilled in the relevant art will recognize, however, that embodiments discussed in the disclosure may be practiced without one or more of the specific details, or with other methods, components, materials, and so forth. In other instances, well-known structures, materials, or operations may not be shown or described in detail to avoid obscuring aspects of the invention.

The systems and methods described herein are not limited to any particular structures, process steps, or materials discussed or disclosed herein. It is understood that any of a wide variety of materials, sizes, shapes, configurations, and adaptations are possible to suit a particular need or use.

It should also be noted that, as used in this specification and the appended claims, singular forms such as "a," "an," and "the" may encompass the plural unless the context clearly dictates otherwise.

As used herein, a plurality of items, structural elements, compositional elements, and/or materials may be presented in a common list for convenience. However, these lists should be construed as though each member of the list is individually identified as a separate and unique member.

Concentrations, amounts, proportions and other numerical data may be expressed or presented herein in a range format. Such ranges or numerical values are used by way of example, and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

Figure 1B:
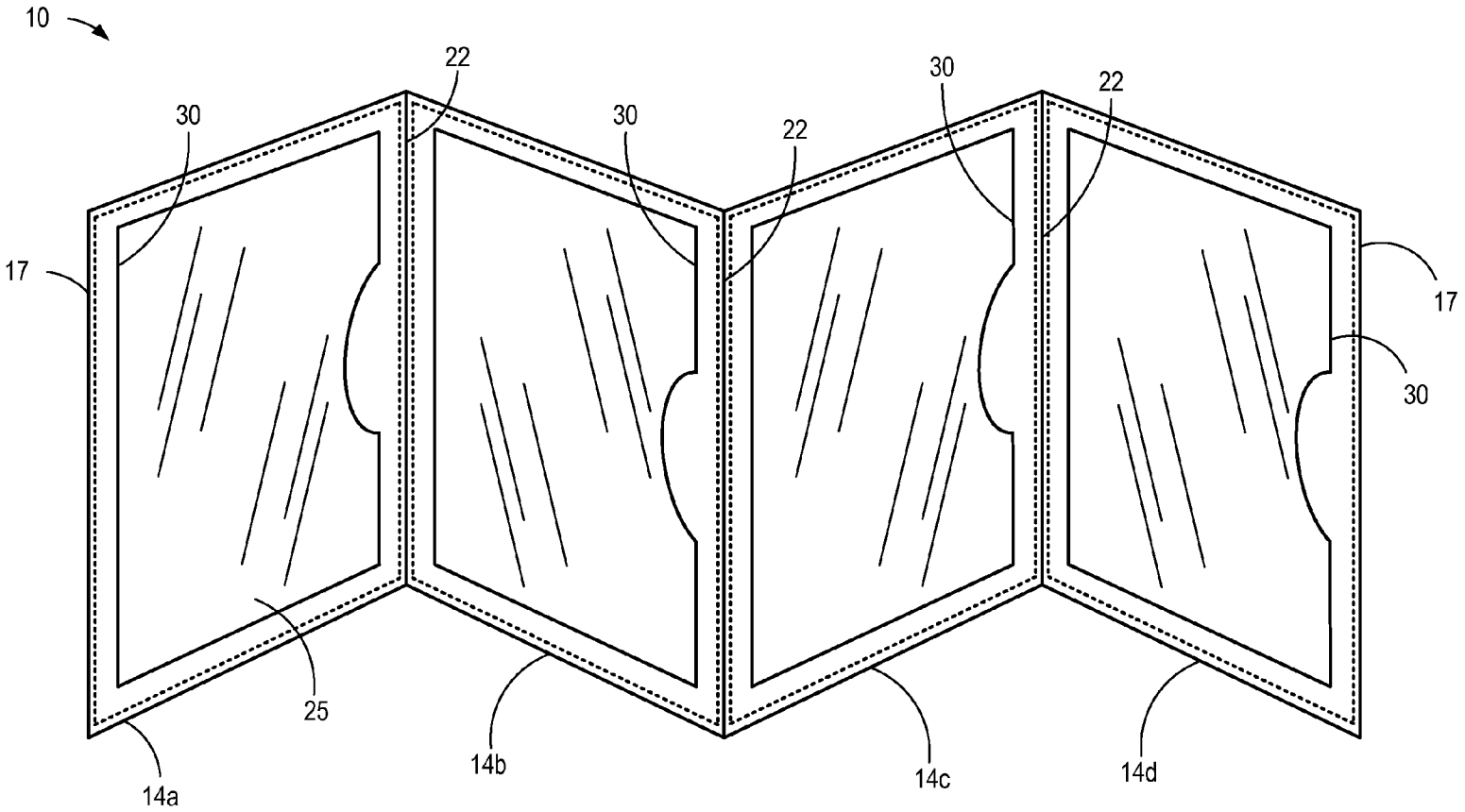
FIG. 1B shows a perspective front view of a multi-page presentation folder with side-entry pockets, as described herein.

FIGS. 1A and 1B illustrates perspective view of a folder according to various embodiments, as indicated generally at 10. According to various configurations, the folder may comprise four panels, 14*a-d*. The four panels each have two vertical edges 17 and are each connected to at least one other panel by at least one vertical edge 17. The folder is foldable along each connected vertical edge 22. Each of the four panels 14*a-d* may have a front side 25 (visible from the view in FIGS. 1A and 1B) and a back side 28 (see, e.g., FIG. 4B).

Each of the front sides 25 and back sides 28 may be adapted to hold at least one or more sheets of material, such as a sheet of music, by way of an attachment member 30. The attachment member 30 may be any suitable attachment member for sheets of material known in the art. By way of example, a clear pocket may be provided with an opening for inserting or removing a sheet. The opening may be on a top or bottom of a portrait orientation, as illustrated in FIG. 1A.

In one alternative embodiment, as illustrated in FIG. 1B, the opening may be on a side of the portrait orientation. In some embodiments, the size and aspect ratio of each panel may be adapted for a particular application. For example, each panel may be square, A4, letter, or other size and/or aspect ratio. Similarly, the panels may be oriented in a landscape or portrait orientation. In some embodiments, each panel may include multiple, independent attachment members. For example, each panel may be configured to hold two half-sheets, or even two full sheets side by side or above or below one another.

While clear protectors are illustrated as the attachment members in many embodiments, any of a wide variety of attachment members are possible, including corner tabs, clips, adhesives, and the like. For example, the attachment member could be a binder clip, or metal fasteners designed to engage holes punched in sheets of material. Numerous other means for holding a sheet of material may also be employed and would be within the scope of the current disclosure.

Figure 2B:
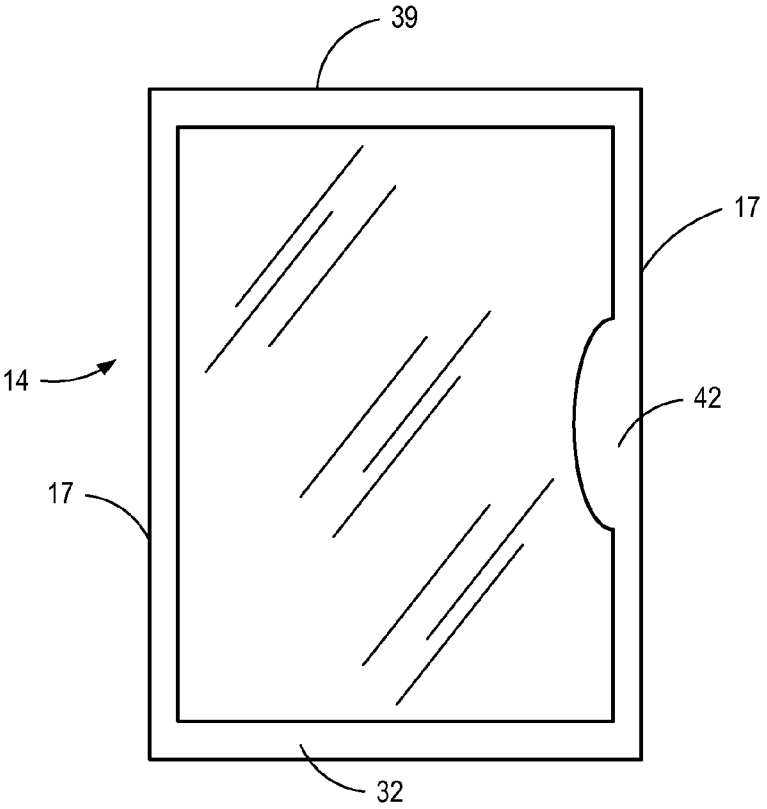
FIG. 2B shows a front view of another possible configuration of a single panel of a multi-page presentation folder.
Figure 2A:
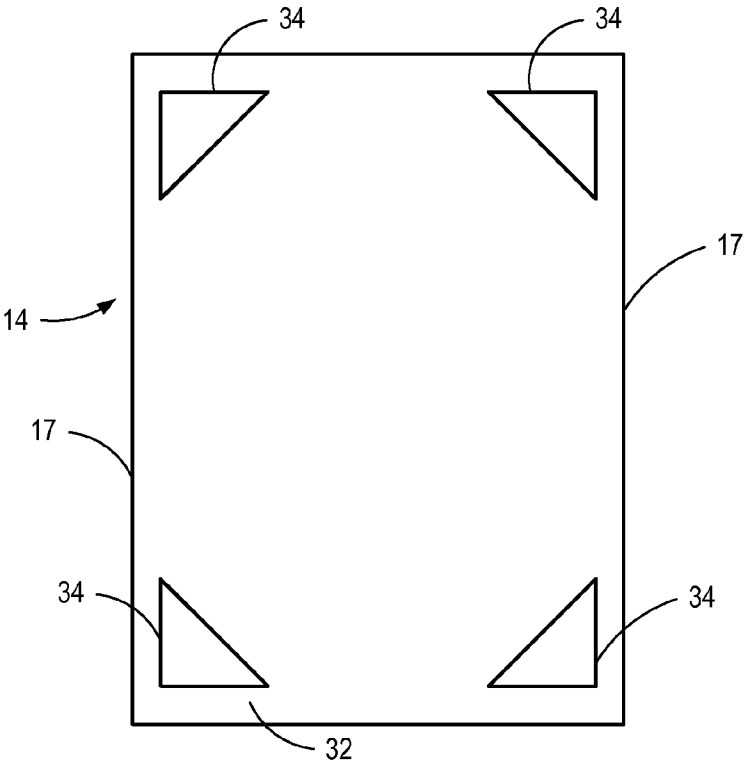
FIG. 2A shows a front view of a possible configuration of a single panel of a multi-page presentation folder.

Turning now to FIGS. 2A and 2B, there are shown detailed front views of examples of panel 14 according to the present disclosure. This panel 14 may be constructed of any suitable material, and may be constructed of a semi-rigid material to provide structural support for the sheets of material and prevent sagging of the sheets under gravity. For example, thin or thick cardboard may be used to form the panel, as well as other materials suitable for folders. The thickness required to provide sufficient rigidity may vary depending on the material used. The folder panels may also be formed of bendable or rigid plastic materials.

The panel may include a margin 32 around the outside edge of the panel to allow for folds. In various embodiments, the size of the margins may be minimized. In other embodiments, the size of the margins may be selected to allow for notations, folding, or other uses. According to the panel 14 in FIG. 2A, there are four corner tabs 34 provided to secure sheets of material to the panel. The corner tabs 34 may be glued, adhered, or otherwise permanently, semi-permanently, or temporarily affixed to the panel and allow one or more sheets of material to be inserted or removed as desired.

According to the panel 14 in FIG. 2B, a clear pocket 39 is provided to secure one or more sheets of material to the panel. The clear pocket 39 may be glued, bonded, sewn, adhered, or otherwise permanently, semi-permanently, or temporarily affixed to the panel. The clear pocket 39 may have a cut-out portion or hole 42 provided in the side, as shown in FIG. 2B (or alternatively, in the top or bottom), to allow sheets of material to be inserted or removed as desired. The clear pocket 39, by way of example, may be slightly larger than a standard-sized music sheet to allow for easy insertion and removal. The slightly larger size may also allow a wider range of sizes of music sheets to be used with the folder as described herein. The size, shape, and dimensions of the clear pocket 39 may be varied based on the intended size of sheets for display and/or based on a general usage. For example, in the United States sheet music may typically be printed in Letter size. Although the size and aspect ratio may vary by application. Similarly, in many foreign countries sheet music may be printed as A4 sheets and the size and shape of the clear pocket 39 and/or the panel 17 may be adjusted accordingly.

According to a configuration of a folder which utilizes four panels—each panel being capable of holding and displaying at least one sheet of music on its front side 25 and at least one sheet of music on its back side 28—the folder may be utilized to store and/or display at least eight sheets of music at a time. In various embodiments, one or more panels may not have a front and a back side. In various embodiments, when the multi-page presentation folder is in a closed position, an outward facing panel may not be configured to hold a sheet, but rather have a logo or other decorative marking or image. In some embodiments, the multi-page presentation folder may include only three panels, capable of displaying up to six sheets with minimal manual page turns. In some embodiments, the panels may be removed or added to a multi-page presentation folder as desired. In such embodiments, panels may be selectively attached to one another by a foldable or hinging temporary connection member, such as metal fasteners, hinges, sewn hinges, molded hinges, magnets, or the like.

In a six panel embodiment, three sheets may be displayed at first, then a single "page turn" may reveal six more sheets and a final "page turn" may review the last three sheets—for a total of twelve sheets. The various illustrated embodiments include a four-panel multi-page presentation folder for displaying up to eight sheets with only two manual page turns, or up to six sheets with only one manual page turn.

It may also be desirable to store the music in the multi-page folder in order to protect the music and keep it organized, and it may also be desirable to be able to easily transport the folder. When storage or transportation of the folder is desired, the folder may be folded along each of the connected vertical edges 22, as indicated by the arrows 38 in FIG. 3. This folded configuration of a multi-page folder is a single panel 14 wide and a single panel 14 tall, with a depth of four panels, and may thus be easier to store and transport.

In use, a musician or other presenter may select up to eight pages of sheet music to be practiced or performed. If sheets of music are inserted into the appropriate attachment members on the fronts and backs of the four panels 14, up to eight sheets of music may be practiced or performed with only two manual "page turns," or turns of the folder, as described herein.

Figure 3:
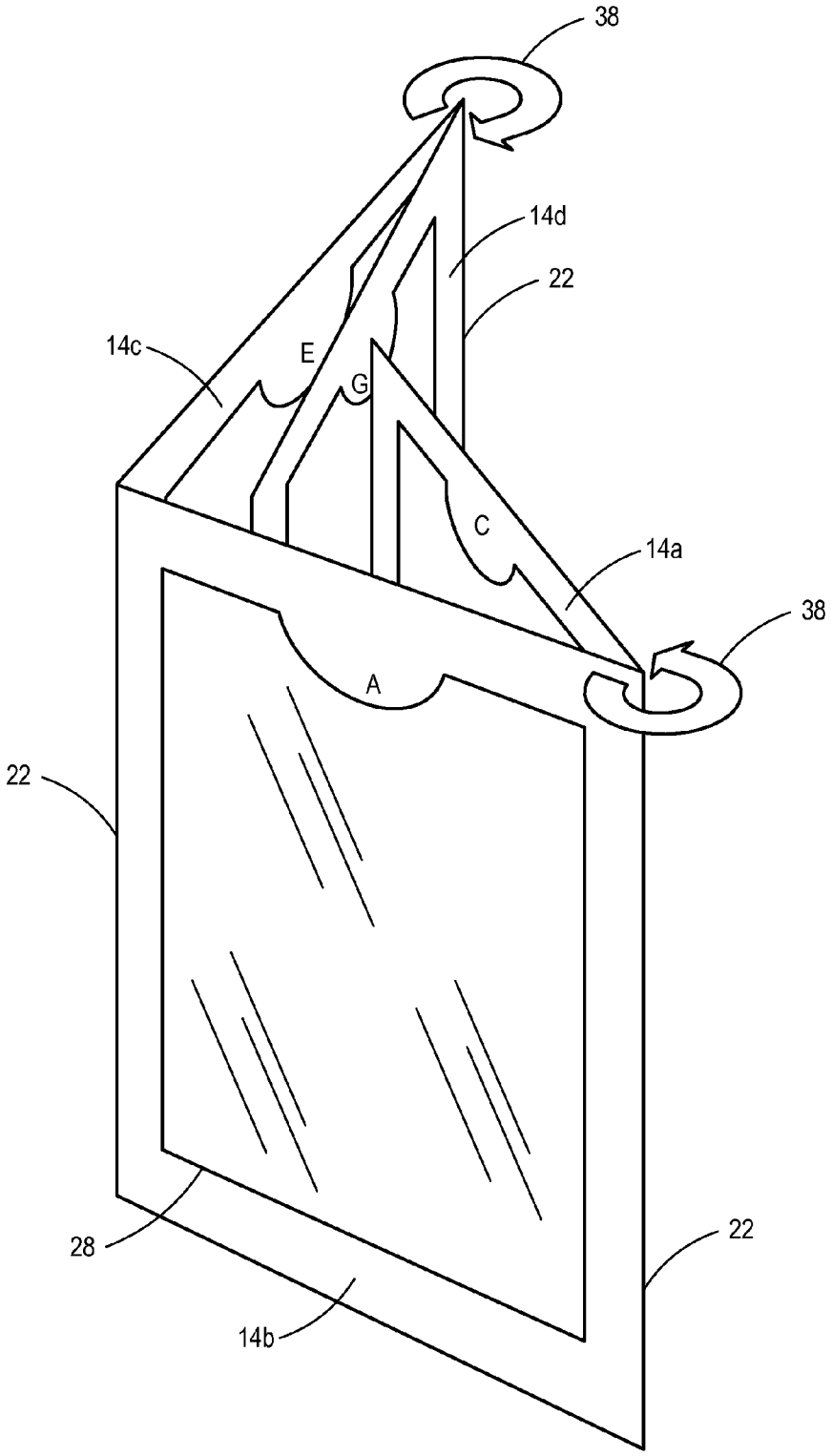
FIG. 3 shows a perspective view of an example of how a multi-page presentation folder as described herein may be folded for storage or transportation.

After selecting sheets of music, the musician may then select a multi-page presentation folder as described herein. By way of example, the musician may select a presentation folder that utilizes four panels, with each of the four panels having a sheet attachment member consisting of a clear pocket with a hole at the top for insertion and removal of sheets. The sheet attachment member may be provided on the front side and back side of each of the four panels. The panels in FIG. 3 are labeled with letters A, C, E, and G that correspond with the panel labeling in FIGS. 4A and 4B.

Figure 4A:
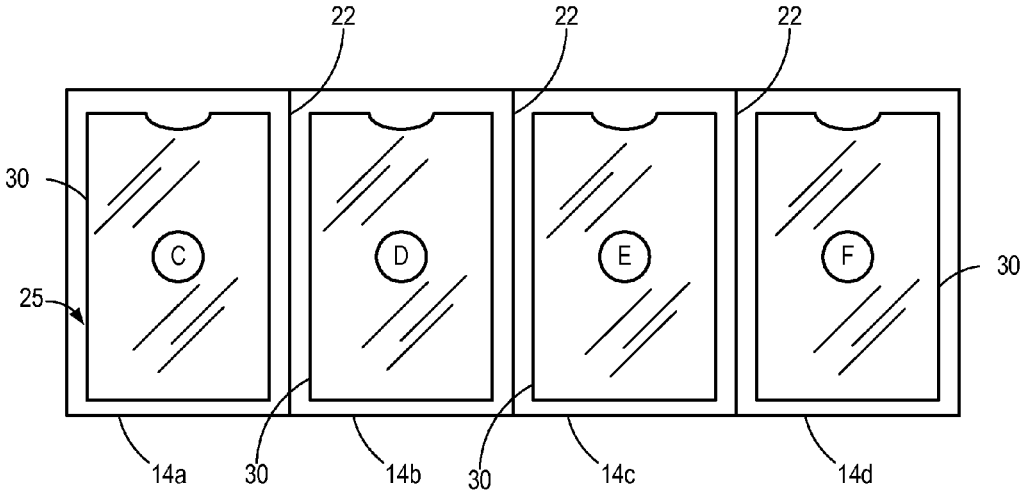
FIG. 4A shows a front view of a multi-page presentation folder with indications for sheet placement.
Figure 4B:
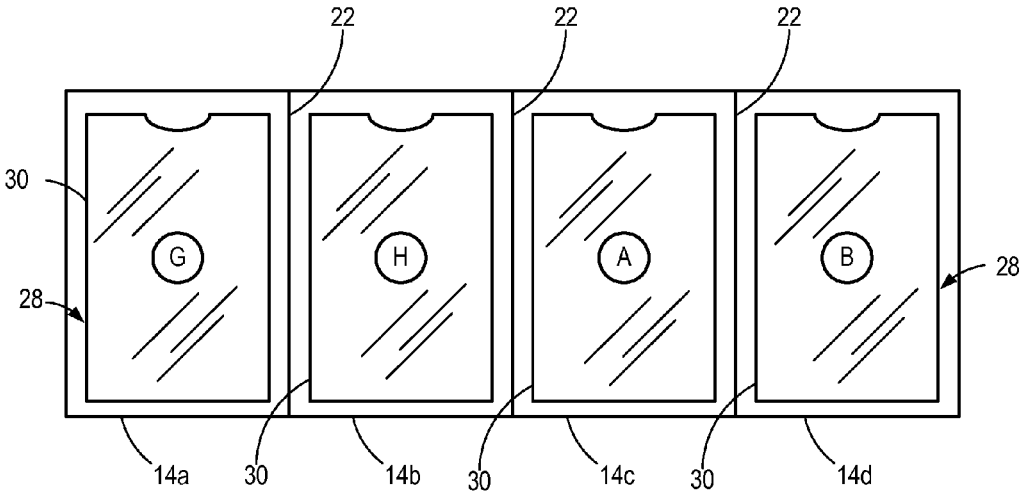
FIG. 4B shows a back view of the multi-page presentation folder of FIG. 4A with indications for sheet placement.

The musician may then load the presentation folder by inserting the sheets of music through the holes in the tops of the clear pockets in the following order (as shown in FIG. 4A, the front view of the folder, and FIG. 4B, the back view of the folder):

a. The first sheet of music may be inserted in the back side 28 of panel 14*c*, at the position labeled "A";
b. The second sheet of music may be inserted in the back side 28 of panel 14*d*, at the position labeled "B";
c. The third sheet of music may be inserted in the front side 25 of panel 14*a*, at the position labeled "C";
d. The fourth sheet of music may be inserted in the front side 25 of panel 14*b*, at the position labeled "D";
e. The fifth sheet of music may be inserted in the front side 25 of panel 14*c*, at the position labeled "E";
f. The sixth sheet of music may be inserted in the front side 25 of panel 14*d*, at the position labeled "F";
g. The seventh sheet of music may be inserted in the back side 28 of panel 14*a*, at the position labeled "G";
h. The eighth sheet of music may be inserted in the back side 28 of panel 14*b*, at the position labeled "H."

Figure 5A:
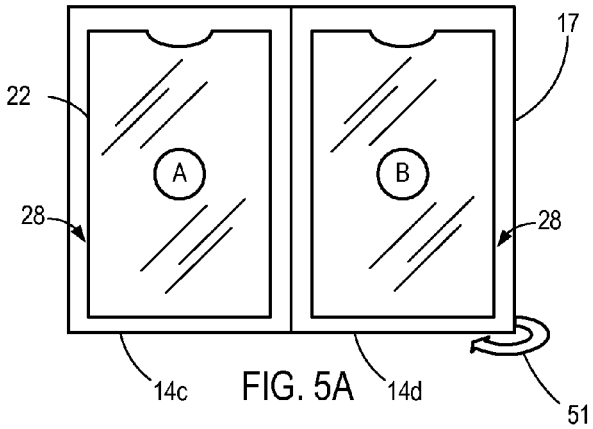
FIG. 5A shows a back view of a multi-page presentation folder when it is in a folded position.

After the multi-page folder has been loaded in this order, the musician may close the folder as shown in FIG. 5A, with the first and second pages of the music (at positions "A" and "B" at the back side 28 of panels 14*c* and 14*d*, respectively) facing the musician on a music stand, or piano music desk, or the like. The musician may play the first and second pages, then may make a "page turn" by opening the folder by grasping the right vertical edge 17 and pulling it to the left, as indicated by the arrow 51 in FIG. 5A. The folder would then appear to the musician as shown in FIG. 5B.

Figure 5B:
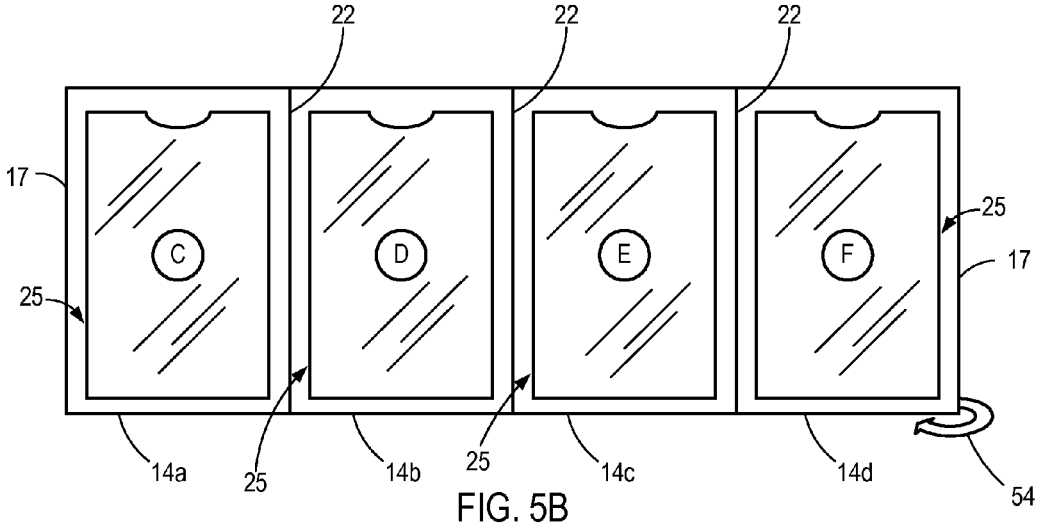
FIG. 5B shows a front view of a multi-page presentation folder of FIG. 5A when it is in an open position.

According to FIG. 5B, the folder is in an open position, such that the front sides 25 of panels 14*a-d* are visible, corresponding to positions C-F and pages 3-6 of the inserted sheet music. The musician, after turning the folder to this open position, may then play the third, fourth, fifth, and sixth pages of music. If there are additional pages, the musician may make a second "page turn" by again grasping the right vertical edge 17 and pulling it to the left, as indicated by the arrow 54 in FIG. 5B. The folder would then appear as shown in FIG. 5C.

Figure 5C:
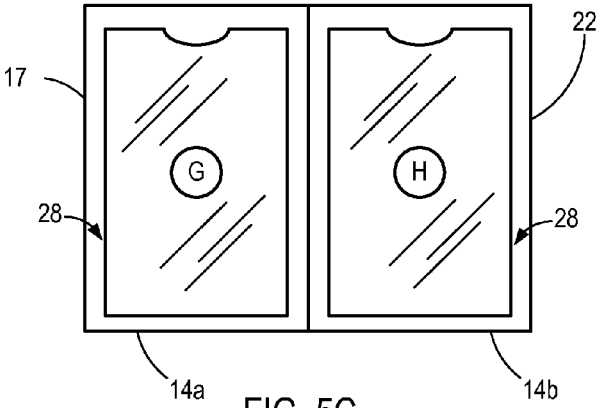
FIG. 5C shows another back view of a multi-page presentation folder when it is in a folded position.

According to FIG. 5C, the back side 28 of panels 14*a* and 14*b* are visible, corresponding to positions "G" and "H," and pages 7 and 8 of the inserted sheet music, respectively. After executing this second page turn, the musician may then play pages 7 and 8 of the inserted sheet music. Thus, the musician may have played up to eight consecutive pages of music while having to perform only two manual page turns. Additionally, the folder may have provided structural stability and prevented the music from sagging or falling of the presentation stand while the musician played. While many of the descriptions are provided herein with respect to musicians and sheet music, it is appreciated that the present systems and methods are equally applicable to the display of any type of paper, plastic, cardboard or other thin sheet of material for any of a wide variety of display or presentation situations.

Figure 6:
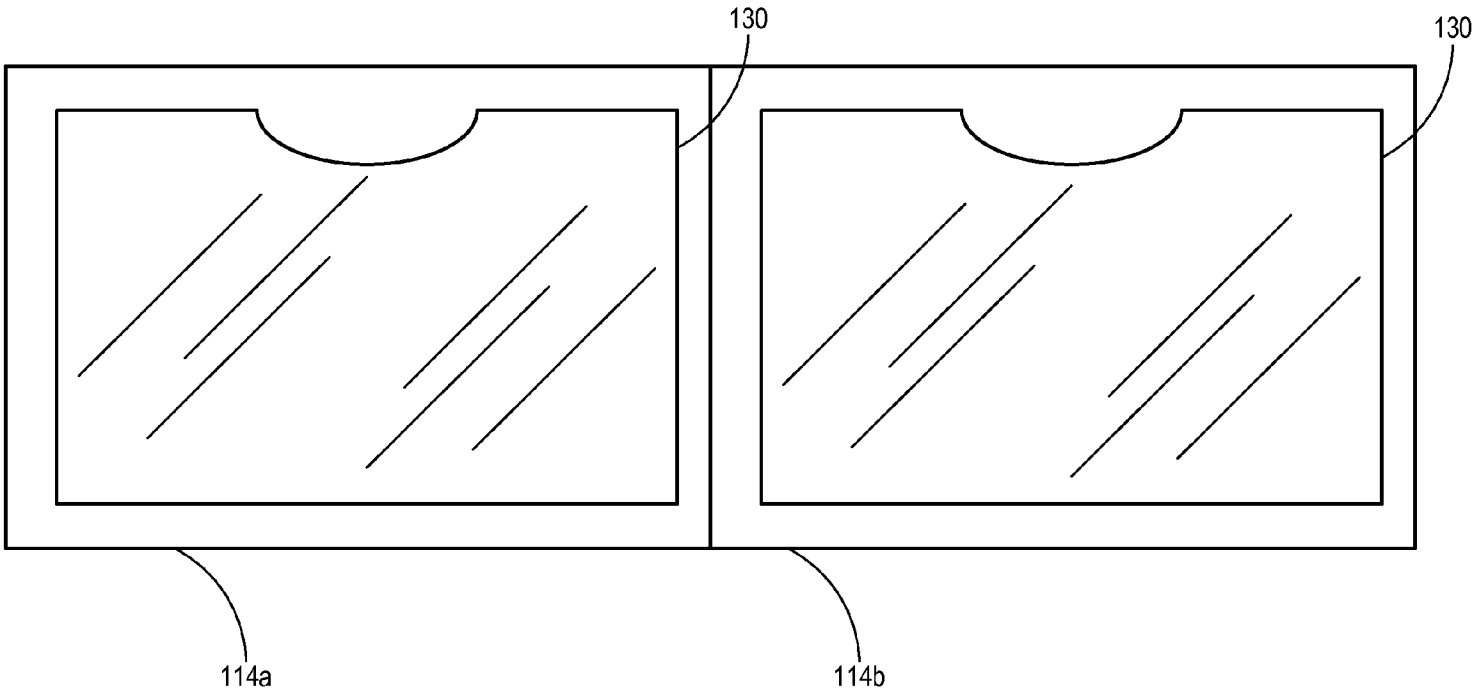
FIG. 6 shows a front view of another possible configuration of a multi-page presentation folder.

Turning now to FIG. 6, there is shown a front view of another possible configuration of the multi-page presentation folder according to the present disclosure. According to this configuration, the folder may have two panels, 114*a* and 114*b*. The two panels 114*a* and 114*b* may each have a front side (visible in FIG. 6) and a back side. Each of the front sides and back sides of the panels 114*a* and 114*b* may be provided with an attachment member 130. This attachment member 130 may be adapted to hold two sheets of material. By way of example, this attachment member may be a double-wide pocket. For example, if the attachment member 130 were configured to hold two Letter-sized sheets, it might have dimensions that are slightly larger than 17 inches by 11 inches (to hold two 8.5-inch by 11-inch sheets)

In an alternative embodiment, the attachment members 130 may be configured to each secure one or more sheets in a portrait orientation with a significant portion of the sheet extending out of the attachment member 130. For example, the illustrated attachment member 130 may be 8.5 inches wide, but only 1-10 inches tall, such that between 10 and 1 inches, respectively, of the sheet extend up and out of the attachment member 130 (or beyond the attachment member in cases in which the attachment ember is a clip).

Alternatively, two attachment members—each configured to hold a single sheet of material in a landscape orientation—on each of the front sides and back sides of the panels 114*a* and 114*b* may be provided.

According to the configuration shown in FIG. 6, the folder may hold up to 8 sheets of material, and when the sheets are loaded in the folder in the manner described above, the sheets may be displayed with a minimum of turns. One with skill in the art will appreciate that many configurations may be used in conjunction with the present multi-page presentation folder, such as the use of two or more panels, the use of four or more panels, various single- or double-attachment members, and various types of attachment members, and all such configurations would be within the scope of the claims of the present disclosure.

A folder for carrying and displaying sheets of material as described herein may include four panels, each of the four panels having two vertical edges and being connected to at least one other panel by at least one vertical edge and forming three connected vertical edges, the folder being foldable along each of the three connected vertical edges. Each of the four panels may have a front side and a back side, with one or both of the front sides and back sides of each of the four panels having an attachment member that is configured to hold at least one sheet of material.

The attachment member may include a pocket, corner tabs, clips, adhesives, hook and loop fasteners (e.g., Velcro), frictional members, clamps, pins, magnetic retainers, and/or other members known to hold paper and the like. It is appreciated that a combination of two or more attachment members may be used in combination. For example, in one embodiment, one or more sheets are inserted into a transparent pocket and secured to a panel via a hook and loop fastener or via corner tabs, or via a clip. As described herein, the folder may be formed of a semi-rigid material. An amount of space may be provided between the vertical edges and the attachment members.

A folder for carrying sheets of material and displaying the sheets may include a pair of panels joined together at a center of the folder and foldable at the center, with each panel having inner and outer surfaces such that the inner surface of each panel is disposed on the inside of the folder, and the outer surface of each panel is disposed on the outside of the folder when the folder is in a closed position. The inner surfaces and outer surfaces may each have an attachment member disposed thereon, the attachment member configured to hold at least two sheets of material. The attachment member may include a clear pocket or corner tabs or the like.

A folder for presenting and storing sheets of material may include a first panel, a second panel, a third panel, and a fourth panel. Each of the first, second, third, and fourth panels may have a left vertical edge and a right vertical edge; the right vertical edge of the first panel being connected to the left vertical edge of the second panel; the right vertical edge of the second panel being connected to the left vertical edge of the third panel; and the right vertical edge of the third panel being connected to the left vertical edge of the fourth panel. Each of the first, second, third, and fourth panels may include a front and a back, each of the front and the back having an attachment member disposed thereon configured to display at least one sheet of material.

A method for presenting sheets of material is also provided, the method including: selecting a folder having a first panel, a second panel, a third panel, and a fourth panel; each of the first, second, third, and fourth panels having a left vertical edge and a right vertical edge; the right vertical edge of the first panel being connected to the left vertical edge of the second panel; the right vertical edge of the second panel being connected to the left vertical edge of the third panel; and the right vertical edge of the third panel being connected to the left vertical edge of the fourth panel. All four panels may have a front and a back, each of the front and the back having an attachment member disposed thereon configured to display at least one sheet of material.

The method may include inserting sheets of material in this manner: inserting a first sheet of material into the attachment member disposed on the back of the second panel; inserting a second sheet of material into the attachment member disposed on the back of the first panel; inserting a third sheet of material into the attachment member disposed on the front of the first panel; inserting a fourth sheet of material into the attachment member disposed on the front of the second panel; inserting a fifth sheet of material into the attachment member disposed on the front of the third panel; inserting a sixth sheet of material into the attachment member disposed on the front of the fourth panel; inserting a seventh sheet of material into the attachment member disposed on the back of the fourth panel; and inserting an eighth sheet of material into the attachment member disposed on the back of the third panel.

Figure 7:
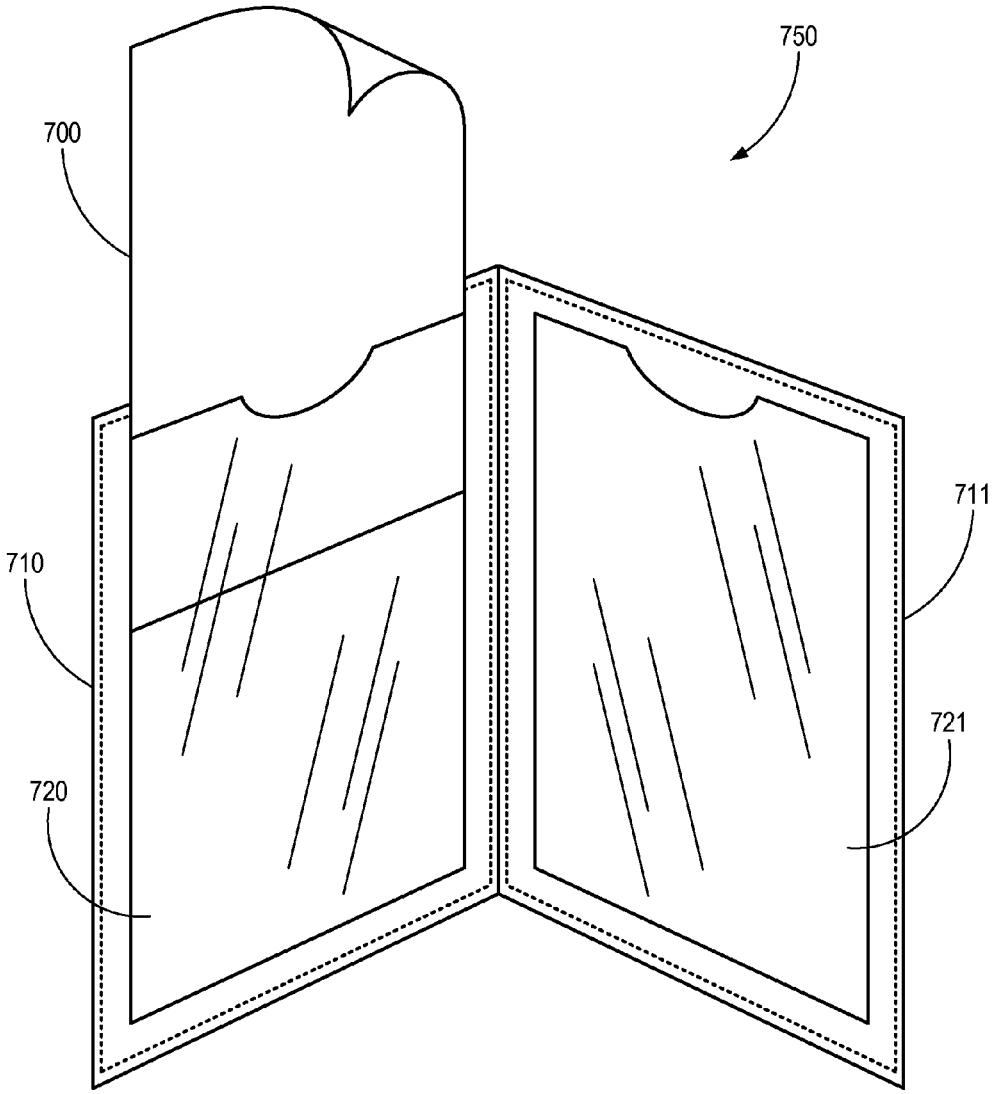
FIG. 7 illustrates a sheet being inserted into one embodiment of a multi-page presentation folder.

FIG. 7 illustrates a sheet 700 being inserted into one embodiment of a multi-page presentation folder 750. In the illustrated embodiment, a sheet 700 is being inserted into a pocket 720 formed by a transparent plastic attached to a panel 710. An adjoining panel 711 may have second pocket 721. In some embodiments, a third and fourth panel may each include one or more additional pockets.

Figure 8:
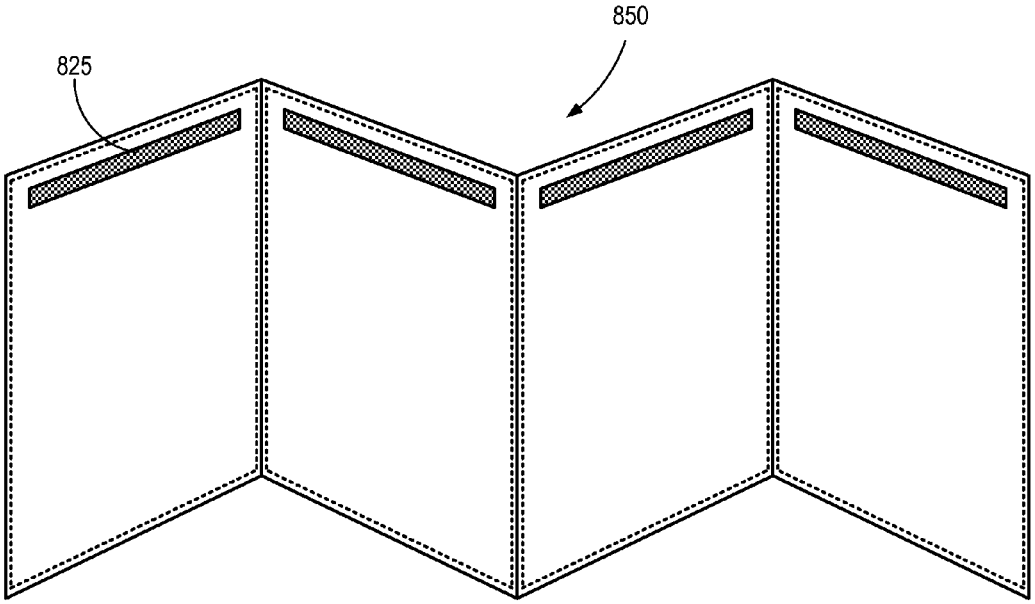
FIG. 8 illustrates an embodiment of a multi-page presentation folder with adhesive strips across the top for securing a sheet or other media.

FIG. 8 illustrates an embodiment of a multi-page presentation folder 850 with adhesive strips 825 across the top for securing a sheet or other media. The reverse side of each panel may include a similar or different attachment member.

Figure 9:
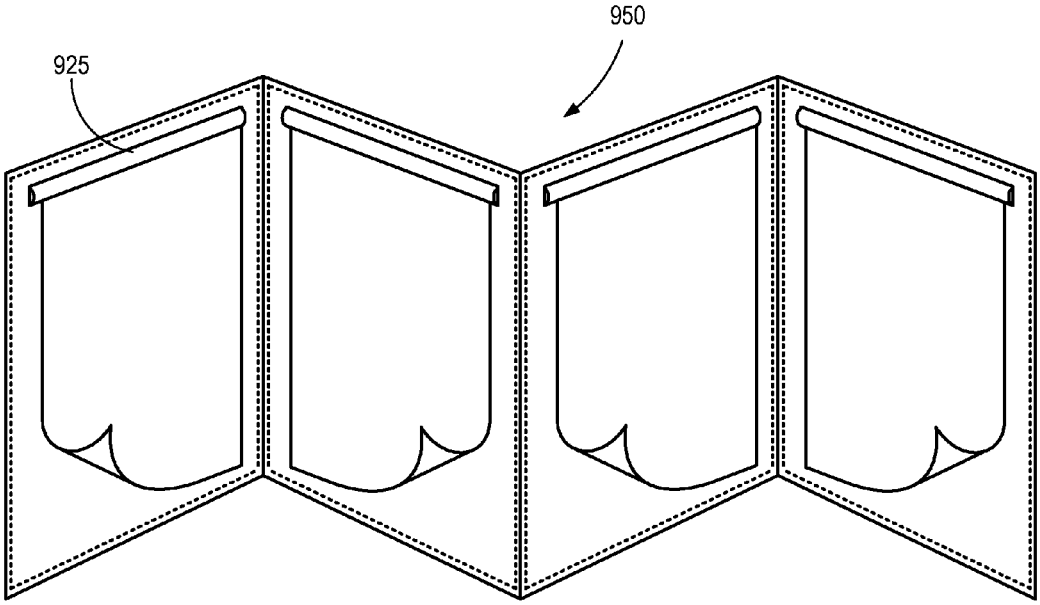
FIG. 9 illustrates another embodiment of a multi-page presentation folder with a sheet fastener across the top for securing a sheet or other media.

FIG. 9 illustrates another embodiment of a multi-page presentation folder 950 with a clip fastener 925 across the top securing a sheet or other media. As in other embodiments, one or more of the panels may include a similar or different attachment member on the back side.

The phrases "connected to" and "integral with" and other related terms refer to any form of interaction between two or more components, including mechanical, electrical, magnetic, electromechanical, and electromagnetic interaction(s). Two components may be connected to each other, even though they are not in direct contact with each other, and even though there may be intermediary devices between the two components.

Various manufacturing techniques, materials, and combinations thereof may be used to create and/or enhance the multi-page presentation folder described herein, including various metals, plastics, rubbers, etc. For example, one or more of the following materials may be utilized: polyethylene terephthalate, polystyrene, polyvinyl chloride, polytetrafluoroethylene, polyvinylidine chloride, polyethylene (LDPE and HDPE), polypropylene, and/or other types of plastics and rubbers. Various manufacturing processes may be utilized as well, including, but not limited to, extrusion, injection molding, blow molding, rotational molding, three-dimensional printing, casting, etching, molding, joining, evaporative-pattern casting, spray forming, dip molding, thermoforming, sewing, fusing, and/or other processes.

Thus, the following detailed description of the embodiments of the systems and methods of the disclosure is not intended to limit the scope of the disclosure, as claimed, but is merely representative of possible embodiments. In addition, the steps of a method do not necessarily need to be executed in any specific order, or even sequentially, nor do the steps need to be executed only once.

This disclosure has been made with reference to various embodiments, including the best mode. However, those skilled in the art will recognize that changes and modifications may be made to the exemplary embodiments without departing from the scope of the present disclosure. While the principles of this disclosure have been shown in various embodiments, many modifications of structure, arrangements, proportions, elements, materials, and components may be adapted for a specific environment and/or operating requirements without departing from the principles and scope of this disclosure. These and other changes or modifications are intended to be included within the scope of the present disclosure.

This disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, a required, or an essential feature or element. The scope of the present invention should, therefore, be determined by the claims provided herein.

What is claimed is:

1. A method for presenting ordered sheets, the method comprising:

displaying a first sheet of a plurality of ordered sheets via a front face of a third panel of a multi-sheet presentation folder, wherein the multi-sheet presentation folder comprises four panels connected sequentially along vertical edges, the four panels configured to fold along at least a first fold line dividing a first panel and a second panel, a second fold line dividing the second panel and a third panel, and a third fold line dividing the third panel and a fourth panel;

folding the multi-sheet presentation folder along the second fold line such that the front faces of the third and fourth panels are displayed and the first and second panels are folded behind the third and fourth panels;

displaying a second sheet of the plurality of ordered sheets via a front face of a fourth panel of the multi-sheet presentation folder while displaying the first sheet via the first panel;

unfolding the multi-sheet presentation folder along the second fold such that the back faces of all four panels are displayed with the panels in reverse order;

displaying a third sheet of the plurality of ordered sheets via a back face of the fourth panel;

displaying a fourth sheet of the plurality of ordered sheets via a back face of the third panel;

displaying a fifth sheet of the plurality of ordered sheets via a back face of the second panel;

displaying a sixth sheet of the plurality of ordered sheets via a back face of the first panel; and folding the music-sheet presentation folder along the first, second, and third fold lines into a storage configuration that has a width and height corresponding to one of the panels and a depth corresponding to the sum of the four panels.

2. The method of claim 1, wherein the ordered sheets comprise ordered music sheets.

3. The method of claim 1, further comprising:

folding the multi-sheep presentation folder along the second fold line such that the front faces of the first and second panels are displayed and the third and fourth panels are folded behind the first and second panels;

displaying a seventh sheet of the plurality of ordered sheets via a front face of the first panel.

4. The method of claim 3, further comprising:

displaying an eighth sheet of the plurality of ordered sheets via a front face of the second panel.

5. The method of claim 1, further comprising:

displaying a logo image on a front face of the second panel.

6. The method of claim 1, wherein each panel comprises a rigid material.

7. The method of claim 1, wherein each panel comprises a transparent pocket.

8. The method of claim 7, wherein each pocket is divided into a front pocket and a back pocket by an opaque material.

9. The method of claim 1, wherein the first sheet of the plurality of ordered sheets comprises a cover sheet.

10. A method for displaying ordered sheets, the method comprising:

displaying a first sheet of a plurality of ordered sheets via a front face of a fourth panel of a multi-sheet presentation folder, wherein the multi-sheet presentation folder comprises four panels connected sequentially along vertical edges, the four panels configured to fold along a first fold line dividing a first panel and a second panel, a second fold line dividing the second panel and a third panel, and a third fold line dividing the third panel and a fourth panel;

folding the multi-sheet presentation folder along the second fold line such that the front faces of the third and fourth panels are displayed and the first and second panels are folded behind the third and fourth panels;

unfolding the multi-sheet presentation folder along the second fold such that the back faces of all four panels are displayed with the panels in reverse order;

displaying a second sheet of the plurality of ordered sheets via a back face of the fourth panel of the multi-sheet presentation folder;

displaying a third sheet of the plurality of ordered sheets via a back face of the third panel;

displaying a fourth sheet of the plurality of ordered sheets via a back face of the second panel;

displaying a fifth sheet of the plurality of ordered sheets via a back face of the first panel; and folding the music-sheet presentation folder along the first, second, and third fold lines into a storage configuration that has a width and height corresponding to one of the panels and a depth corresponding to the sum of the four panels.

11. The method of claim 10, further comprising displaying a logo on the front face of the third panel.

12. The method of claim 10, wherein the ordered sheets comprise ordered music sheets.

13. The method of claim 10, further comprising:

folding the multi-sheep presentation folder along the second fold line such that the front faces of the first and second panels are displayed and the third and fourth panels are folded behind the first and second panels;

displaying a sixth sheet of the plurality of ordered sheets via a front face of the first panel.

14. The method of claim 13, further comprising:

displaying an seventh sheet of the plurality of ordered sheets via a front face of the second panel.

15. The method of claim 13, further comprising:

displaying an logo on a front face of the second panel.

16. The method of claim 10, wherein each panel comprises a rigid material.

17. The method of claim 10, wherein each panel comprises a transparent pocket.

18. The method of claim 17, wherein each of the transparent pockets is divided into a front pocket portion and a back pocket portion by an opaque material.

* * * * *